United States Patent [19]

deNora et al.

[11] 4,302,321

[45] Nov. 24, 1981

[54] NOVEL SINTERED ELECTRODES

[75] Inventors: Vittorio deNora, Geneva, Switzerland; Giuseppe Bianchi; Antonio Nidola, both of Milan, Italy

[73] Assignee: Diamond Shamrock Technologies S.A., Geneva, Switzerland

[21] Appl. No.: 119,471

[22] Filed: Feb. 7, 1980

Related U.S. Application Data

[63] Continuation-in-part of Ser. No. 856,486, Dec. 1, 1977, abandoned, which is a continuation of Ser. No. 436,687, Jan. 25, 1974, abandoned.

[30] Foreign Application Priority Data

Jan. 26, 1973 [IT] Italy ..... 19679 A/73

[51] Int. Cl.[3] ..... C25B 1/34; C25B 11/04

[52] U.S. Cl. ..... 204/291; 204/292

[58] Field of Search ..... 204/291, 292; 429/45

[56] References Cited

U.S. PATENT DOCUMENTS

| | | | |
|---|---|---|---|
| 3,141,835 | 7/1964 | Rolin et al. | 204/291 X |
| 3,544,378 | 12/1970 | Broyde | 429/13 |
| 4,146,438 | 3/1979 | deNora et al. | 204/1.5 |
| 4,187,155 | 2/1980 | deNora et al. | 204/67 |

*Primary Examiner*—F. Edmundson

*Attorney, Agent, or Firm*—Hammond & Littell, Weissenberger and Muserlian

[57] ABSTRACT

Novel electrodes comprising a body formed of a sintered mixture of powders of at least one film-forming metallic material and at least one additive metal selected from the group consisting of Cr, Mn, Re, Fe, Co, Ni, Ca, Ag, Au, Zn, Cd, Ge, Sn, Pb, La and the lanthanide series of the Periodic Table and oxides, metallates and intermetallates thereof and their preparation and electrolysis cells containing the said electrodes as the anode thereof and electrolysis processes using the said electrodes as anodes.

13 Claims, No Drawings

NOVEL SINTERED ELECTRODES

PRIOR APPLICATION

The present application is a continuation-in-part application of copending, application Ser. No. 856,486 filed Dec. 1, 1977, now abandoned which is a continuation of application Ser. No. 436,687 filed Jan. 25, 1974, now abandoned.

STATE OF THE ART

Recently dimensionally stable electrodes for anodic and cathodic reactions in electrolysis cells have been used, for example, in the manufacture of chlorine and caustic by electrolysis of aqueous solutions of alkali metal chloride, for metal electrowinning in hydrochloric acid and sulfuric acid solutions, and for other processes in which an electric current is passed through an electrolyte for the purpose of decomposing the electrolyte, for carrying out organic oxidations and reductions, or to impress a cathodic potential to a metallic structure which has to be protected from corrosion.

They have been particularly valuable in flowing mercury cathode cells and in diaphragm cells for the production of chlorine and caustic, in metal electrowinning cells in which pure metal is recovered from a chloride or sulfate solution as well as in the cathodic protection of ship hulls and structures.

Dimensionally stable electrodes have been prepared with valve metal bases such as titanium, tantalum, zirconium, hafnium, vanadium, niobium and tungsten, or "film-forming" alloys, which in service develop a corrosion resistant but non-electrically conductive oxide or barrier layer which prevents the further flow of anodic current through the anode except at substantially higher voltage and, therefore, cannot be used successfully as anodes. It has, therefore, been considered necessary to cover at least a portion of the valve metal such as a titanium or tantalum anode with an electrically conductive layer of noble metal from the platinum group (i.e., platinum, palladium, iridium, osmium, rhodium, ruthenium) or electrically conductive and electrocatalytic noble metal oxides as such or mixed with valve metal oxides and other metal oxides. These conductive layers usually completely cover the active surface of the electrically conductive base except for inevitable pores through the coating, which pores were, however, sealed by the development of the barrier layer above referred to on the "film-forming" base.

Coatings made of, or containing, a platinum group metal or of platinum group metal oxides are, however, expensive and are consumed or deactivated in the electrolysis process and, therefore, reactivation processes or recoatings are necessary to replace deactivated anodes. Up to now, the commercial electrodes for chlorine and oxygen evolution have been prepared by coating a valve metal base with a noble metal from the platinum group or with either a separately applied coating containing oxides or with separately applied coating compositions which under thermal treatment generate a layer containing oxides.

OBJECTS OF THE INVENTION

It is an object of the invention to provide novel long lasting electrodes which are mechanically and chemically resistant to the conditions found in electrolytic cells as well as in cathodic protection, and which do not require separately applied conductive coatings.

It is another objection of the invention to provide novel processes for the preparation of electrodes for electrolysis cells.

It is another object to provide methods for preactivating, whenever necessary, electrodes made with the metal of the electrode for use in electrolysis cells.

It is a further object of the invention to provide novel electrolysis methods using the electrodes of the invention.

It is another object of the invention to provide a novel method of producing corrosion resistant electrodes by sintering a mixture of metal powders comprising at least a valve metal powder and a metal powder of at least one metal belonging to Groups VIB, VIIB, VIII, IIB, IB, IVA, lanthanium and lanthanide series of the Periodic Table, such as chromium, manganese, molybdenum, rhenium, iron, ruthenium, osmium, cobalt, rhodium, iridium, nickel, palladium, platinum, copper, silver, gold, zinc, cadmium, tin, lead, germanium and lanthanum and preactivating whenever necessary, said electrodes.

It is another object of the invention to provide a novel method of producing corrosion resistant electrodes by sintering a mixture of metal powder and metal oxides or intermetallic compounds or metallates powder, the latter providing conductive nuclei on the surface of the electrode which remains permanently actived.

It is an additional object of the invention to provide methods to pre-activate the surfaces of the novel electrodes of the invention.

These and other objects and advantages of the invention will become obvious from the following detailed description.

THE INVENTION

The novel electrodes of the invention are comprised of a body formed of a sintered mixture of powders of at least one film-forming metallic material and at least one additive metal selected from the group consisting of Cr, Mn, Re, Fe, Co, Ni, Ca, Ag, Au, Zn, Cd, Ge, Sn, Pb, La and the lanthanide series of the Periodic Table and oxides, metallates and intermetallates thereof. The preferred electrodes are those wherein the additive metal is in the form of an oxide.

The self-sustaining sintered body consisting of the powder of the film-forming metallic material and the additive metal or oxides, metallates or intermetallates thereof are prepared by grinding the materials together, or separately, preferably to a grain size between 50 and 500 microns, to provide a powder mixture which contains a range of grain sizes to obtain a better degree of compaction. According to one of the preferred methods, the mixture of powders is mixed with water or with an organic binding agent to obtain a plastic mass having suitable flowing properties for the particular forming process used. The material may be molded in known manner either by ramming or pressing the mixture in a mold or by slip-casting in a plaster of Paris mold or the material may be extruded through a die into various shapes.

The molded electrodes are then subjected to a drying process and heated at a temperature at which the desired bonding can take place, usually between 800° to 1800° C. for a period of between 1 to 30 hours normally followed by slow cooling to room temperature. The heat treatment is preferably carried out in an inert atmosphere or one that is slightly reducing, for example in $H_2+N_2$ (80%), when the powdered mixture is composed essentially of metal compound with a minor portion of other metal oxides or metals.

When the powdered mixture contains also metallic powders, it is preferable to carry out the heat treatment in an oxidizing atmosphere, at least for a portion of the heat treatment cycle to promote the oxidation of metallic particles in the outside layers of the electrodes. The metallic particles remaining inside the body of the sintered material improve the electrical conductivity properties of the electrode.

The forming process may be followed by the sintering process at a high temperature as mentioned above or the forming process and the sintering process may be simultaneous, that is, pressure and temperature may be applied simultaneously to the powder mixture, for example by means of electrically-heated molds. Lead-in connectors may be fused into the ceramic electrodes during the molding and sintering process or attached to the electrodes after sintering or molding. Other methods of shaping, compressing and sintering the powder mixture may of course be used.

The additive elements or compounds constitute the electrocatalytically active and electroconductive nuclei on the surface of the sintered electrodes and it is not necessary that the concentration of the additive element or compound be uniform through the entire section of the sinterized electrode but, by appropriate powder mixing technique or other means, the suitable concentration of the additional metal or metal compound can be achieved only in the surface layers leaving the bulk of the sinterized electrode composed only by the matrix material.

It has been found that in most cases the amount of the additive metal or metal compound added is sufficient to be as low as 0.1% by weight and can be as high as 50% by weight or more.

Examples of film-forming metals are titanium, tantalum, zirconium, halfnium, vanadium, niobium and tungsten. Examples of a film-forming metal alloy is a silicon-iron alloy, wherein the silicon content is 14.5% by weight as metallic silicon.

Examples of metals belonging to Groups VI, VIIB, VIII, IIB, IB, IVA, lanthanum and lanthanide series of the Periodic Table are chromium, molybdenum, manganes, rhenium, iron, ruthenium, osmium, cobalt, rhodium, iridium, nickel, palladium, platinum, copper, silver, gold, zinc, cadmium, tin, lead, germanium and lanthanum. The amount of said metals in the alloys can be as low as 0.1 and as high as 50%, preferably 10 to 30%, by weight of the alloy.

Among preferred electrode embodiments of the invention are electrodes made of titanium or any of other film-forming metals with 1 to 50% by weight of nickel or cobalt or an alloy of iron-silicon containing up to 20% of silicon, preferably about 14.5%.

The electrodes of the invention not containing the additive metal in the oxide form may be subjected to one of the following activation processes which forms a layer of oxides of the metals consituting the sintered body on the outer surface of the electrode or mixed crystals of oxides of said metals. Other activation processes than those specifically described may be used. The anodes of the invention are able to withstand operating conditions in commercial electrolysis cells for chlorine production equally as well as valve metal anodes coated with an active layer of a platinum group metal or an oxide of a platinum group metal of the prior art, and they operate for cathodic protection as well as titanium anodes coated with an active layer as described in the prior art.

The electrodes may be cleaned before subjected to the activation processes described herein. This may be effected by sandblasting or by light etching in hydrochloric acid for 5 to 45 minutes followed by washing with distilled water or by other cleaning processes.

The electrodes are also provided, before or after activation, with means to connect the electrodes to a source of electric current.

One means of activating the electrode comprises dipping the electrode in a molten salt for up to 10 hours at a temperature slightly higher than the melting point of the specific molten salt. Said salts are preferably inorganic alkali metal oxidizing salts or mixtures thereof such as sodium nitrate, potassium persulfate, potassium pyrophosphate, sodium perborate and the like.

Another method of activating the electrodes comprises heating the electrodes in an oxidizing atmosphere to a temperature of from 500° to 1200° C. for up to 10 hours and optionally maintaining the electrodes at such temperature in an inert atmosphere such as nitrogen or argon for up to 10 hours. Preferably, the electrodes are slowly cooled at a rate of 10° to 80° C. per hour, usually in an inert atmosphere.

A third method of activating the electrodes comprises anodic polarization of the electrode in an aqueous sulfuric acid solution or an aqueous alkaline solution with a current density preferably of 600 to 3000 $A/m^2$ at 30° to 50° C. for up to 10 hours. Other activation methods which will oxidize the alloy may be used to form active coatings on the surface of the alloy metal of the electrode. Stated limits for temperature, time of oxidizing treatment, current density are only indicative in so far during experiments it has been found that comparable performance results were obtained from test coupons after a definitive pre-activation treatment while for another set of different test coupons such a limit would be somewhat different.

The activation methods of the invention appear to promote the formation of a mixed crystal or a composite crystal layer of oxides of the metals forming the outer surface of the alloy electrode base, which layer covers the entire surface of the electrode base and in the instances where measurements have been made is approximately 1 to 30 microns thick. The oxide layer may, however, cover only a portion of the electrode metal.

The electrodes of this invention are particularly useful for electrowinning processes used in the production of various metals because they do not add impurities to the electrolyte bath which would deposit onto the cathode, together with the metals being won, as do anodes of, for example, lead containing antimony and bismuth, which give impure cathode refined metals. Moreover, their resistance to acid solutions and to oxygen evolution and their low anode potential make them desirable for their use.

In the following examples several preferred embodiments are described to illustrate the invention. However it should be understood that the invention is not intended to be limited to the specific embodiments.

EXAMPLE 1

Sintered materials obtained by a mixture of metal powders of mesh Nos. comprised between 60 and 320 and having the composition as indicated hereinbelow in Table I were used as anodes for the electrolysis of a 10% $H_2SO_4$ solution at 60° C. under a current density over projected area of 1.2 KA/m$^2$. The experimental results are summarized in Table I.

TABLE I

| Composition of sintered material % by weight | | | | | Anode potential V(NHE) | | Weight Loss |
|---|---|---|---|---|---|---|---|
| Ti | Co | Ni | $TiO_2$ | $RuO_2$ | Initial Value | After 10 Days | mg/cm$^2$ |
| 93 | 0 | 3 | 4 | 0 | 2.39 | 2.40 | 1.5 |
| 93 | 0 | 2 | 4 | 1 | 1.60 | 1.61 | negligible |
| 93 | 1 | 1 | 4 | 1 | 1.56 | 1.58 | negligible |
| 90 | 3 | 3 | 3 | 1 | 1.54 | 1.56 | negligible |

The following remarks can be made:

I—The presence of $RuO_2$ sharply improves the catalytic activity for oxygen evolution.

II—The addition of cobalt slightly increases the catalytic activity for the oxygen evolution.

III—The addition of $RuO_2$ or cobalt and $RuO_2$ sharply decrease the metal weight loss.

The last three samples are very suitable to their use as anodes in electrolysis processes in which oxygen is evolved at the anode, such as in most metal electrowinning processes.

EXAMPLE 2

Sintered materials obtained by a mixture of metal powders of mesh Nos. comprised between 60 and 320 and having the composition as indicated in Table II were used as anodes for the electrolysis of 10% $H_2SO_4$ solution at 60° C. under a current density over projected area of 1.2 KA/m$^2$. The experimental results are summarized in Table II.

TABLE II

| Composition of sintered material % by weight | | | | | | Anode potential V(NHE) | | Metal Weight Loss |
|---|---|---|---|---|---|---|---|---|
| Ti | Co | Ni | $TiO_2$ | Ir | $IrO_2$ | Initial value | After 10 days | mg/cm$^2$ |
| 93 | 0 | 3 | 4 | 0 | 0 | 2.30 | 2.40 | 1.5 |
| 93 | 0 | 2 | 4 | 0 | 1 | 1.60 | 1.63 | negligible |
| 93 | 0 | 1 | 4 | 1 | 1 | 1.54 | 1.54 | negligilble |
| 93 | 1 | 1 | 3 | 1 | 1 | 1.53 | 1.53 | negligible |

The three last samples are characterized by a low anodic potential which remained substantially uncharged after 10 days of operation and by an extremely low metal weight loss.

EXAMPLE 3

Sintered materials obtained by a mixture of metal powders of mesh Nos. comprised between 60 and 320 and having the composition as indicated in Table III were used as anodes for the electrolysis of $H_2SO_4$ 10% solution at 60° C. under a current density over projected area of 1.2 KA/m$^2$. The experimental results are indicated in the following Table.

TABLE III

| Composition of sintered material % by weight | | | | | Anode Potential V(NHE) | | Metal Weight Loss |
|---|---|---|---|---|---|---|---|
| Ti | Co | Ni | Pt | Ir | Initial Value | After 10 Days | mg/cm$^2$ |
| 93 | 0 | 7 | 0 | 0 | 2.2 | 2.7 | 8.0 |
| 93 | 0 | 5 | 2 | 0 | 2.0 | 2.2 | 1.5 |
| 93 | 0 | 5 | 0 | 2 | 1.70 | 1.72 | negligible |
| 93 | 0 | 5 | 1 | 1 | 1.68 | 1.70 | negligible |

TABLE III-continued

| Composition of sintered material % by weight | | | | | Anode Potential V(NHE) | | Metal Weight Loss |
|---|---|---|---|---|---|---|---|
| Ti | Co | Ni | Pt | Ir | Initial Value | After 10 Days | mg/cm$^2$ |
| 93 | 2.5 | 2.5 | 1 | 1 | 1.67 | 1.68 | negligilbe |

The three last samples show a low anodic potential and an extremely low metal weight loss which makes them very useful as anodes for electrolysis processes wherein oxygen is evolved at the anode.

EXAMPLE 4

Sintered materials obtained by a mixture of metal powders of mesh Nos. comprised between 60 and 320 and having the composition as indicated in Table IV were used as anodes for the electrolysis of the 10% $H_2SO_4$ solution at 60° C. under a current density over proejected area of 1.2 KA/m$^2$. The experimental results are indicated in the following Table.

TABLE IV

| Composition of sintered material % by weight | | | | Anode Potential V(NHE) | | Metal Weight Loss |
|---|---|---|---|---|---|---|
| Ti | $Co_3O_4$ | $Fe_3O_4$ | $RuO_2$ | Initial Value | After 10 Days | mg/cm$^2$ |
| 90 | 10 | 0 | 0 | 1.90 | 2.0 | 1.5 |
| 90 | 0 | 10 | 0 | 1.97 | 2.10 | 2.5 |
| 90 | 2.5 | 5.0 | 2.5 | 1.80 | 1.80 | negligible |
| 90 | 5 | 5 | 0 | 1.83 | 1.87 | negligible |
| 90 | 2.5 | 2.5 | 5 | 1.77 | 1.78 | negligible |

The following remarks can be made:

I—The addition of $RuO_2$ sharply improves the catalytic activity for oxygen evolution.

II—The addition of $Co_3O_4+Fe_3O_4$ slightly increases the catalytic activity.

III—The addition of $RuO_2$ and/or $Co_3O_4+Fe_3O_4$ sharply lowers the metal weight loss.

The last three samples show a low anodic potential and a very good resistance to corrosion.

EXAMPLE 5

Sintered materials obtained by a mixture of metal powders with mesh Nos. comprised between 60 and 320 and having a composition as indicated in Table V were tested as anodes for the electrolysis of 10% $H_2SO_4$ solution at 60° C. and at a current density of 1.2 KA/m$^2$. The experimental results are detailed in Table V.

TABLE V

| Composition of sintered material % by weight | | | | | Anode Potential V(NHE) | | Weight Loss |
|---|---|---|---|---|---|---|---|
| Fe | Co | Cr | W | Si | Initial Value | After 10 Days | mg/cm$^2$ |
| 60 | 20 | 5 | 15 | 0 | 1.9 | 1.9 | 20 |
| 60 | 20 | 5 | 10 | 5 | 2.1 | 2.1 | negligible |
| 60 | 10 | 5 | 15 | 10 | 2.0 | 2.1 | negligible |
| 60 | 10 | 10 | 5 | 15 | 2.0 | 2.3 | negligible |

The addition of silicon greatly improves the metal corrosion resistance while lowering only slightly the catalytic activity for oxygen evolution.

EXAMPLE 6

Sintered materials obtained by a mixture of metal powders with mesh Nos. comprised between 60 and 320 and having composition as indicated in Table VI were tested as anodes for the electrolysis of 10% $H_2SO_4$ solution at 60° C. and at a current density of 1.2 KA/m$^2$. The experimental results are reported in the following Table.

TABLE VI

| Composition of sintered material % by weight | | | Anode Potential V(NHE) | | Weight Loss |
|---|---|---|---|---|---|
| Ti | $SnTa_2O_7$ | $IrTa_2O_7$ | Initial Value | After 10 Days | mg/cm$^2$ |
| 80 | 20 | 0 | 1.7 | 1.7 | negligible |
| 90 | 0 | 10 | 1.5 | 1.5 | negligible |

The presence of metallates in the valve metal matrix sharply increases the electrocatalytic activity for oxygen evolution while their presence does not effect the very good corrosion resistance.

EXAMPLE 7

Sintered materials of similar composition as described in Example 1 were pre-activated by dipping the test coupons in a molten potassium persulfate bath for 5 hours. They were then used as anodes for the electrolysis of a saturated sodium chloride aqueous solution at 60° C. with a current density of 5 KA/m$^2$. The experimental results are reported in the following Table.

TABLE VII

| Composition of sintered material % by weight | | | | | Anode Potential V(NHE) | | Weight Loss |
|---|---|---|---|---|---|---|---|
| Ti | Co | Ni | $TiO_2$ | $RuO_2$ | Initial Value | After 10 Days | mg/cm$^2$ |
| 93 | 0 | 3 | 4 | 0 | 2.9 | 3.3 | 10 |
| 93 | 0 | 2 | 4 | 1 | 1.70 | 1.75 | 2.0 |
| 93 | 1 | 1 | 4 | 1 | 1.68 | 1.70 | 1.0 |
| 90 | 3 | 3 | 3 | 1 | 1.65 | 1.69 | 1.0 |

The presence of $RuO_2$ sharply improves the catalytic activity for chlorine evolution and the metal weight loss is sharply reduced. Addition of Cobalt and Nickel further improves the performance of the anodes.

EXAMPLE 8

Sintered materials of similar composition as described in Example 2 were pre-activated by anodic polarization in a 10% by weight sodium hydroxide solution at a current density of 3 KA/m$^2$ for 10 hours. The test coupons were then used as anodes for the electrolysis of a saturated sodium chloride aqueous solution at 60° C. with a current density of 5 KA/m$^2$. The experimental results are reported in the following Table.

TABLE VIII

| Composition of sintered material % by weight | | | | | | Anode Potential V(NHE) | | Weight Loss |
|---|---|---|---|---|---|---|---|---|
| Ti | Co | Ni | $TiO_2$ | Ir | $IrO_2$ | Initial Value | After 10 days | mg/cm$^2$ |
| 93 | 0 | 3 | 4 | 0 | 0 | 2.55 | 2.60 | 10 |
| 93 | 0 | 2 | 4 | 0 | 1 | 1.85 | 1.88 | 2.5 |
| 93 | 0 | 1 | 4 | 1 | 1 | 1.73 | 1.74 | 1.6 |
| 93 | 1 | 1 | 3 | 1 | 1 | 1.60 | 1.60 | 1.5 |

The last test sample shows a low anode potential which remained unchanged after 10 days of operation. The metal weight loss for the same period was 1.5 mg/cm$^2$.

EXAMPLE 9

Sintered materials of similar composition as described in Example 3 were pre-activated by anodic polarization in a 10% weight sodium hydroxide solution at a current density of 3 KA/m$^2$ for 10 hours. The test coupons were then used as anodes for the electrolysis of a saturated sodium chloride aqueous solution at 60° C. with a current density of 5 KA/m$^2$. The experimental results are reported in the following Table.

TABLE IX

| Composition of sintered material % by weight | | | | | Anode Potential V(NHE) | | Weight Loss |
|---|---|---|---|---|---|---|---|
| Ti | Co | Ni | Pt | Ir | Initial Value | After 10 Days | mg/cm$^2$ |
| 93 | 0 | 7 | 0 | 0 | 2.3 | 3.0 | 20 |
| 93 | 0 | 5 | 2 | 0 | 2.2 | 2.5 | 10 |
| 93 | 0 | 5 | 0 | 2 | 2.0 | 2.3 | 5 |
| 93 | 0 | 5 | 1 | 1 | 1.65 | 1.67 | 2 |
| 93 | 2.5 | 2.5 | 1 | 1 | 1.60 | 1.60 | 1 |

The two last samples of the table show a low anode potential for chlorine evolution which remained practically unchanged after ten days of operation. The corresponding metal weight losses were also low.

EXAMPLE 10

Sintered materials of similar composition as described in Example 4 were pre-activated by anodic polarization in a 10% by weight sodium hydroxide solution at a current density of 3 KA/m$^2$ for 10 hours. The test coupons were then tested as anodes for the electrolysis of a saturated sodium chloride aqueous solution at 60° C. with a current density of 5 KA/m$^2$. The experimental results are reported in the following Table.

TABLE X

| Composition of sintered material % by weight | | | | Anode Potential V(NHE) | | Weight Loss |
|---|---|---|---|---|---|---|
| Ti | $Co_3O_4$ | $Fe_3O_4$ | $RuO_2$ | Initial Value | After 10 Days | mg/cm$^2$ |
| 90 | 10 | 0 | 0 | 2.10 | 2.20 | 20 |
| 90 | 0 | 10 | 0 | 1.97 | 1.98 | 10 |
| 90 | 0 | 0 | 10 | 1.90 | 1.93 | negligible |
| 90 | 5 | 5 | 0 | 1.57 | 1.57 | negligible |
| 90 | 2.5 | 2.5 | 5 | 1.45 | 1.45 | neglibible |

The last test sample in the table shows a remarkably low anode potential for chlorine evolution associated with very good corrosion resistance.

EXAMPLE 11

Sintered materials of similar compositions as described in Example 6 were pre-activated by anodic polarization in a 10% by weight sodium hydroxide solution at a current density of 3 KA/m$^2$ for 10 hours. The test coupons were then used as anodes for the electrolysis of a saturated sodium chloride aqueous solution at 60° C. with current density of 5 KA/m$^2$. The experimental results are reported in the following Table.

TABLE XI

| Composition of sintered material % by weight | | | Anode potential V(NHE) | | Weight Loss |
|---|---|---|---|---|---|
| Ti | $SnTa_2O_7$ | $IrTa_2O_7$ | Initial Value | After 10 Days | mg/cm$^2$ |
| 80 | 20 | 0 | 1.7 | 1.75 | negligible |
| 90 | 0 | 10 | 1.5 | 1.55 | negligible |

The addition of metallates to the valve metal matrix sharply increases the catalytic activity. The last test sample in the table shows a low anode potential for chlorine evolution and a very good corrosion resistance.

Anodes prepared according to the invention, and comprising other film-forming metals such as the valve metals tantalum, zirconium, niobium, vanadium, hafnium, tungsten and film-forming iron alloys or sinterized with other metals, metal oxides, intermetallic compounds and metallates which provides on the surface of the film-forming matrix active nuclei which interrupt the non-conductive barrier layer and permit the formation of an electrically conductive and electrocatalytic film thereon may be used in electrolysis processes for chlorine evolution, oxygen evolution and other purposes such as fused salt electrolysis, electrowinning, electrophoresis, organic and aqueous solutions electrolysis, cathodic protection and the like.

The electrodes may be connected into an electrolysis cell circuit in any desired manner and are provided with suitable means to make connection to a source of electrolysis current in diaphragm or mercury cathode chlorine cells, electrowinning cells or any other type of electrolysis cells.

As will be seen from the various examples, the electrodes of the invention may be used in chlorine and oxygen evolution and other electrolysis processes by merely preactivating the alloy composition (or a portion of the alloy composition) forming the surface of the electrode. The activation layer may be formed from the substrate at the surface of the electrode, without the application of a separate coating layer, and is, therefore, cheaper to produce, more adherent to the surface of the electrode and more easily restored (re-activated) after use if necessary than the separately applied coatings of the prior art moreover in some uses (i.e., oxygen evolution), the activation layer is self-generating and regenerating in service—thereby giving long life, inexpensive anodes for use particularly in metal electrowinning, which do not add impurities to the metal being recovered.

Various modifications of the products and processses of the invention may be made without departing from the spirit or scope thereof and it should be understood that the invention is not limited by the illustrative examples given and is intended to be limited only as defined in the appended claims.

We claim:

1. An electrode comprising a body formed of a sintered mixture of powders of at least one film-forming metallic material selected from the group consisting of a valve metal and silicon-iron alloys and at least one additive metal selected from the group consisting of Cr, Mn, Re, Fe, Co, Ni, Cu, Ag, Au, Zn, Cd, Ge, Sn, Pb, La and the lanthanide series of the Periodic Table and oxides, metallates and intermetallates thereof, the additive metal at the surface of the electrode being in the oxide form.

2. An electrode of claim 1 wherein the film-forming metallic material is selected from the group consisting of titanium, zirconium, tantalum, vanadium, tungsten, hafnium and silicon-iron alloys.

3. An electrode of claim 1 wherein the film-forming metallic material is titanium.

4. An electrode of claim 1 wherein the outer surface of the base is titanium containing 1.0 to 50% by weight of nickel oxide or cobalt oxide.

5. An electrode of claim 1 wherein the additive metal is in its oxide form.

6. An electrode of claim 1 wherein the body is comprised of at least one film-forming metallic material and at least one metal belonging to Groups VIB, VIIB, VIII, IIB, IB, IVA and lanthanum and lanthanide series of the Periodic Table and is obtained by sintering a mixture of powders of the metals comprising the surface of the base.

7. The electrode of claim 6 wherein oxides of at least one of the metals belonging to the said Groups of the Periodic Table are sintered with the film-forming metal matrix.

8. The electrode of claim 6 wherein intermetallic compounds of at least one of the metals belonging to the said Groups of the Periodic Table are sintered with the film-forming metal matrix.

9. The electrode of claim 6 wherein metallates comprising at least one of the metals belonging to the said Groups of the Periodic Table are sintered with the film-forming metal matrix.

10. The electrode of claim 6 wherein the powders have a mesh number comprised between 60 and 320.

11. The electrode of claim 6 wherein the film-forming metal material is selected from the groups consisting of titanium, tantalum, zirconium, niobium, vanadium, tungsten, hafnium and silicon-iron alloys.

12. The electrode of claim 6 wherein the concentration of metals belonging to said Groups of the Periodic Table is greater near the surface of the sintered electrode than within its bulk.

13. An electrode comprised of a body formed of a sintered mixture of powders consisting essentially of (a) 75 to 93% by weight of at least one film-forming metallic material selected from the group consisting of titanium, zirconium, tantalum, vanadium, tungsten, niobium, hafnium, and silicon-iron alloys, (b) 0 to 25% by weight of at least one member of the group consisting of metals and oxides of cobalt, nickel, iron and chromium, (c) 0 to 10% by weight of at least one member of the group consisting of platinum group metals and their oxides and (d) 0 to 4% by weight of titanium dioxide, the sum of (b) and (c) being at least 3% by weight and the sum of (b), (c), and (d) being at least 7% by weight.

* * * * *